United States Patent [19]

Nocke

[11] 4,251,108

[45] Feb. 17, 1981

[54] METHOD OF AND AN ARRANGEMENT FOR LONGWALL MINING

[75] Inventor: Hermann H. Nocke, Essen, Fed. Rep. of Germany

[73] Assignee: Ruhrkohle Aktiengesellschaft, Essen, Fed. Rep. of Germany

[21] Appl. No.: 35,504

[22] Filed: May 2, 1979

[30] Foreign Application Priority Data

May 8, 1978 [DE] Fed. Rep. of Germany ..... 2820020

[51] Int. Cl.[3] ..... E21C 35/20

[52] U.S. Cl. ..... 299/8; 299/18; 299/43

[58] Field of Search ..... 299/8, 18, 43, 64

[56] References Cited

U.S. PATENT DOCUMENTS

| | | | |
|---|---|---|---|
| 3,260,548 | 7/1966 | Reichl | 299/18 |
| 3,845,990 | 11/1974 | McCain | 299/18 X |
| 3,924,895 | 12/1973 | Leasure | 299/18 X |
| 4,032,195 | 7/1976 | Kilroy | 299/18 X |

OTHER PUBLICATIONS

Dahl and Petry "Update on Slurry Transportation From Face to Cleaning Plant" Mining Congress Journal 12–77 pgs. 14–16 & 18.

FOREIGN PATENT DOCUMENTS 599284 3/1948 United Kingdom ..... 299/18

*Primary Examiner*—Ernest R. Purser
*Attorney, Agent, or Firm*—Michael J. Striker

[57] ABSTRACT

Material removed from a longwall mining face is comminuted to obtain particles of predetermined size. A hydraulic fluid is circulated through the thusly obtained particles at a pick-up location so as to entrain and convey the particles from the pick-up location through a conduit to a separating location. At the separating location the hydraulic fluid is separated from the particles. The separated hydraulic fluid is recirculated from the separating location back to the pick-up location and into entraining contact with additional particles at the pick-up location.

39 Claims, 3 Drawing Figures

METHOD OF AND AN ARRANGEMENT FOR LONGWALL MINING

BACKGROUND OF THE INVENTION

The present invention relates to a method of and an arrangement for longwall mining.

More particularly, the present invention concerns a method of and an arrangement for excavating material from a longwall mine.

It is known in the art of longwall mining to excavate the removed material by means of various mechanical transporters which may have different constructions, forms and configurations. The transporter may be formed as an endless belt or band conveyor, a rail-guided lifting cart conveyor, cage- or skip-winding arrangement, etc. These transporters have been used with a relative success in the conventional mechanical as well as in the hydromechanical longwall mining. However, it has been recognized that such transporters are not satisfactory with respect to the requirements made to simplicity, economy and ergonomics (i.e. biotechnological factors) of the arrangements for excavating material from the longwall mine.

As far as the economical reasons are concerned, the conventional mechanical transporters require on the one hand considerably high initial capital expenses for adequate driving means and on the other hand continuous service and attention from operators through the service life of the transporters. Besides, the transporters require considerable amount of space in a rather narrow longwall mine. Further, the transporters are very sensitive to any curves along the elongation of the mine. It is known to be a troublesome task to accommodate the mechanical transporter in a slightly curved and ascending longwall mine. Furthermore, even after the transporter has been installed, the latter is still susceptible to troubles during the mining process.

With respect to the ergonomics, the conventional transporters tend to develop dust formations during excavating the material from the longwall mine. The dust formations are most likely to develop on transition zones of the conventional transporter. The dust formation, besides its own negative affect on the operators, lead to the danger of fire or accidents and eventually to an undesirable heat emission of the material to be excavated into the atmosphere.

These disadvantages, especially important in the case where the concentration of the material to be excavated from the longwall mine is increased, are particularly negative in the hydromechanical mining with hydraulically removing the material from the longwall mine. Apart from the fact that the hydraulic fluid which should be as uniform as possible has to be directed onto the mining face (i.e. which must have no series of depressions) at an angle below 15° relative to the horizon, the mining face should have a matrix rock which is not sensitive to water (if the hydraulic fluid is water) and the mine galleries should have a special cross-section. Only if all these conditions are met, the hydraulic fluid simply washes the particles off the mining face, for example, into open troughs. However, in order to overcome a considerable difference in an elevation during excavating the material from the longwall mine it is known to use pipes of pumping the fluid together with the removed particles from the mine. However, the method of excavating the removed material using open troughs has a significant disadvantage that the maxtrix rock eventually swells (i.e. soaks), which fact considerably increases the maintenance costs of such a longwall mine. Besides, the evaporation of water (which takes place due to the heat development during the mining process) increases the humidity of the air within the mine which makes the working conditions for the miners in this mine practically unbearable. Further, the fluid (i.e. water) may soak into the structure which is located below the mining face which fact leads to development of the still-water formations which negatively affect the mining process.

It is to be understood, that the above-discussed and other aerotechnical problems developed in the mine during the mining process can be solved only by way of expensive additional expenditures.

It is also known to excavate the removed material from the longwall mining hydraulically through closed tubes. Thus, for example, in the case of the hydromechanical mining there may be used a hydraulic hoist (i.e. so-called geiger-method) for excavating the removed material from the mine. However, as a rule, the hydraulic hoist requires that the excavated material to be comminuted prior to excavation so as to obtain particles of size below 30 mm, and preferably below 10 mm, which requirement makes the process of mining considerably more expensive.

SUMMARY OF THE INVENTION

It is a general object of the present invention to avoid the disadvantages of the prior art arrangements for and methods of longwall mining.

More particularly, it is an object of the present invention to provide such an arrangement for and a method of longwall mining that the removed material can be excavated from the longwall mine in a simple, inexpensive and reliable manner.

Another object of the present invention is to provide such an arrangement for and a method of longwall mining so that the ergonomic factors of the excavated material are considerably improved.

In pursuance of these objects and others which will become apparent hereafter, one feature of the present invention resides in a method of longwall mining, including the steps of removing material to be excavated from a longwall mining face and comminuting the removed material to obtain particles of predetermined size. A hydraulic fluid is circulated through the thus-obtained particles at a pick-up location so as to entrain and convey the particles from said pick-up location through conduit means to a separating location. At the separating location the hydraulic fluid is separated from the entrained particles. The separated hydraulic fluid is recirculated from the separating location back to said pick-up location and into entraining contact with additional particles at said pick-up location.

In accordance with another feature of the invention an arrangement for longwall mining comprises means for removing material to be excavated from a longwall mining face, means for comminuting the removed material to obtain particles of predetermined size, means for circulating a hydraulic fluid through the thus-obtained particles at a pick-up location so as to entrain and convey the particles from the pick-up location through conduit means to a separating location. There are further provided means for separating the hydraulic fluid from the entrained particles at said separating location and means for recirculating the separated hydraulic fluid from said separating location back to said pick-up location and into entraining contact with additional particles at said pick-up location.

In a preferred embodiment of the present invention the removed material is comminuted to obtain particles of size between 80 and 150 mm (i.e. maximum).

In yet another feature of the invention the hydraulic fluid separated from the entrained particles at the separating location is mixed with additional amount of the hydraulic fluid before such a mixture is introduced back to the pick-up location.

If compared with the known methods of excavating the removed material from the longwall mine, the method of the present invention eliminates any danger of dust and fire development during excavating of the removed material from the pick-up location. Obviously, any danger of an accident during the excavation of the removed material also is avoided. Besides, any undesirable heat emission into the atmosphere during excavating the removed material is eliminated. The tubes for introducing the hydraulic fluid in and withdrawing the same with the entrained particles from the pick-up locations require relatively little floor space as opposed to the prior-art arrangements for this purpose. The floor space saved, especially the space in the longwall mines, may be used for other elements of the installation. Further, the arrangement of the present invention is not overly sensitive to the curves and elevations along the mine, and requires considerably less service and attention from operators as opposed to the known arrangements for the same purpose. Moreover, since the susceptibility to troubles of the arrangement of the present invention is considerably reduced, the frequency of shutting down the arrangement due to any accident during the excavation process is considerably reduced if compared with the prior-art excavating arrangements.

The hydraulic excavating of the removed material from the longwall mine renders it possible to adjust (i.e. vary) the excavating capacity in accordance with the actual working conditions. Thus, for example, it becomes possible to considerably increase the excavating capacity, which fact renders it possible to increase the capacity of the mining process correspondingly.

In still another feature of the invention, the hydraulic excavating arrangement may be installed in a simple and reliable manner in a conventional main level or hoisting of the longwall mine. The driving means for such an arrangement may be assembled and disassembled in a simple and fast manner. Due to this feature, the freedom of arranging the driving means in any of convenient locations of the mine is substantially increased.

If compared with the hydromechanical mining where the removed material is excavated hydraulically through open troughs or the like, the arrangement of the present invention avoids all the shortcomings of these prior-art arrangements. Obviously, the excavating productivity of the arrangement of the invention is significantly increased as opposed to that of the open troughs. Besides, all the limitations of the open troughs are eliminated in the case of the arrangement of the present invention. Thus, the arrangement for longwall mining, in accordance with the invention, is considerably less limiting as to the type of material to be excavated and the configuration of the longwall mining face.

Apart from the considerably improved ergonomic factors and the significantly reduced manufacturing and operating costs, another advantageous feature of the present invention resides in rationalizing the service (i.e. maintenance) of the arrangement which leads to simplifying and improving the operation of the same. Thus, due to the fact that the arrangement takes up a relatively little floor space the working personal has considerably more space to move and, therefore, has a better accessibility to the different parts of the arrangement. Besides, the arrangement of the invention renders it possible to considerably increase the capacity of the mining devices which have been already installed in the longwall mine. The arrangement makes it possible to conduct the excavation continuously throughout a working day. Though it is possible, as far as the economical reasons are concerned, to comminute the removed material (i.e. particles) right in the working passage, namely at the outlet therefrom, of the mining gallery, it is preferable to comminute the removed material only after the latter reaches the main passage of the mining gallery. For this purpose, the main passage is provided with a transporter, e.g. a scraper conveyor (which extends from the working passage into the main passage) which transports the removed material into the main passage from the working passage. The transporter moves the removed material into a crushing device (i.e. breaker) and further into a bunker which is located upstream of the breaker if viewed in the direction of movement of the removed material along the main passage. The bunker is provided at one side thereof with an inlet pipe connection for connecting the bunker to a feeding tube for introducing the hydraulic fluid (e.g. water) into the bunker. The bunker is provided at another side thereof with an outlet pipe connection for connecting the bunker to a withdrawing tube for withdrawing the hydraulic fluid with the entrained particles from the bunker. The whole installment, that is the conveyor, the bunker and the breaker, moves along the main passage. Obviously, the length of the feeding and withdrawing tubes must be changed, correspondingly, during movement of the whole installment. Such movement along the main passage can be conducted, for example, by means of a hydraulic cylinder unit or by any other convenient means.

The hydraulic fluid with the entrained particles flows through a system of interconnected tubes into a central bunker. From the central bunker the hydraulic fluid with the entrained particles flows under pressure through a system of vertical tubes into a separating device which is located above ground. In this separating device the hydraulic fluid is separated from the entrained particles.

In accordance with another embodiment of the present invention only a part of the longwall mining sections may be provided with the hydraulic excavation. In this case it is advisable to direct the hydraulic fluid flow in the central bunker and separate the hydraulic fluid from the entrained particles under the ground rather than above the ground. In this case, the mixture of the entrained particles is subdivided into two fractions, namely one fraction of the fine-comminuted particles and another fraction of the coarse-comminuted particles. Only the fine-comminuted fraction entrained in the hydraulic fluid in the form of sludge is pumped through the vertical tubes to the separating device which is located above the ground. The comparatively coarse-comminuted fraction is mixed up with the removed material transported by the conventional mechanical means. Such a mixture is excavated by the conventional excavating means into conventional mining containers located above the ground.

Should the material to be excavated be coking coal, then the size of the particles in the fine-comminuted fraction is below 10 mm, whereas the size of the particles in the coarse-comminuted fraction is between 10 mm and 150 mm (i.e. maximum) and preferably below 100 mm.

In order to relieve the excavating hoisting shaft, it may be advisable to provide separate passages of small diameters for the hydraulic fluid introducing and withdrawing tubes, respectively. The same is valid for the hoisting arrangement between different levels, or between an upper level and the ground surface.

In order to relieve the main passage, it may be further advisable to conduct the introducing and withdrawing of the hydraulic fluid outside of the main level, that is in a level which is separated from the main level. It is preferable to locate this installment above the main level.

In a further feature of the invention, the return pipes are provided with controlling devices for closing the return pipe to thereby prevent any chance of introducing dirt into the circulating system. It is advantageous to install such controlling devices under the ground before the central bunker so as to completely, or at least substantially, prevent the dirt (i.e. waste) from entering the central bunker.

The hydraulic excavating system includes a number of substantially circumferentially uninterrupted tubes and set of pumps spaced from each other. The pumps circulate the hydraulic fluid, i.e. means for excavating the removed material, through the feeding tubes into the bunker and further into the withdrawing tubes. The circulated hydraulic fluid entrains the particles contained in the bunker and transports these particles into the collecting bunker. The same pumps displace the whole installment including the main passage conveyor for receiving the removed material from the working passages.

The breaker is adapted to comminute the removed material to obtain the particles of size between 80 mm and preferably below 150 mm. The breaker is fixedly located in the main passage conveyor so as to constitute together with the latter the bunker and an air-locking arrangement a rigid unit which is movable along the main passage.

In the preferred embodiment of the present invention the breaker constitutes a striking rolling crusher. In order to ensure that the removed material, after having been comminuted by the breaker, does not contain any particles bigger than 150 mm, it may be advisable to install a conventional separating device. Instead of the separating device, there may be provided a double rolling crusher which reduces the danger that the particles bigger than 150 mm would pass into the hydraulic fluid tubes.

In a still further feature of the invention, the conveyor, the breaker and the bunker are provided with a dust clothing so as to prevent any dust formations along the main passage where the removed material is displaced by means of the conventional mechanical conveyor.

The bunker for receiving the comminuted material and the hydraulic fluid is formed as a conventional rotatable bunker having a number of cells.

In order to continue to circulate the hydraulic fluid even when the mining arrangement is shut down, there is provided a conduit connection which communicates the withdrawing tube with the feeding tube outside the bunker. The conduit connection is provided with a by-pass valve. The withdrawing tube is provided with a shut-off valve which can be remote controlled. Thus, when the by-pass valve is closed and the shut-off valve is open the hydraulic fluid flows from the feeding tube through the bunker into the withdrawing tube. However, when the by-pass valve is open and the shut-off valve is closed, the hydraulic fluid flows directly from the feeding into the withdrawing tube, that is without flowing through the bunker.

In order to most effectively reduce service and maintenance expenses it may be advantageous to provide the tubes (which communicate with the bunker in the main passage) with a movable pump unit located near the bunker. The pump unit includes a driving motor and pressure pumps. Obviously, it is possible to install the pump unit at any other location of the tubes; however, it is preferable to locate the pump unit adjacent to the main-passage bunker. It is further preferable to install the pump unit immediately before the bunker and the by-pass valve. The pumps used in the pump unit may be of a simple conventional construction having, preferably, a rather small wear caused by the hydraulic fluid (i.e. water) flowing therethrough.

In order to protect the hydraulic excavating system against possible malfunction and if so desired, the hydraulic system may be provided at convenient locations thereof, with additional check valves, throttle valves, and the like. The additional valves are, preferably, remote controlled and automatically actuated.

Adjacent to the main-passage bunker, there is provided a collecting tank which receives the hydraulic fluid with the entrained particles from the main-passage bunker. The collecting tank may constitute, however, an intermediate bunker or the central bunker which receives at least a part of (or all) the removed material.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
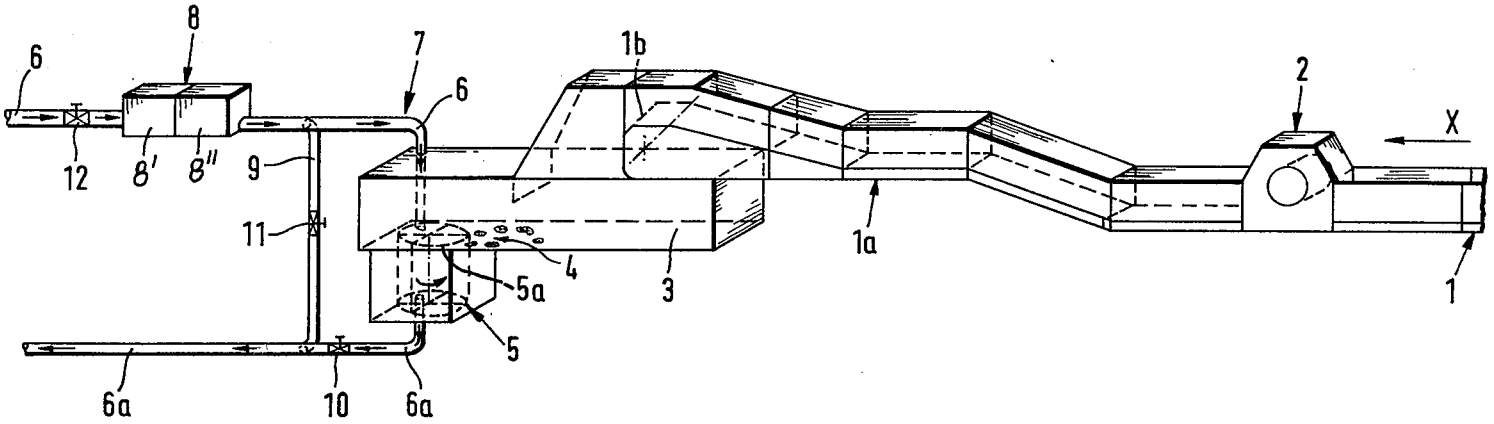
FIG. 1 is a side view of an arrangement for longwall mining in accordance with the present invention.

DESCRIPTION OF THE PREFERRED EMBODIMENTS:

Referring now to the drawings and first to FIG. 1 thereof, it may be seen that an arrow X designates a direction of movement of a removed material from a working passage (not shown) on a transporter 1 along a main passage (not shown) of a longwall mining gallery.

In a preferred embodiment the transporter 1 is a double-chain scraper conveyor which is provided with a striking rolling crusher 2. The crusher 2 is rigidly mounted on the transporter 1. The transporter 1 has a longitudinally extending portion 1*a* and a slightly ascending portion 1*b*. The portions 1*a* and 1*b* extend above a bunker 3 which is located immediately below the outlet of the transporter 1 (i.e. of the portion 1*b* thereof). The crusher 2 is adapted to comminute the material removed in the working passages so as to obtain particles 4 having size between 80 mm and 150 mm (i.e. maximum). Thus, the transporter 1 carries the removed material through the crusher 2, where the material is comminuted to obtain the particles 4, and the comminuted particles 4 through the portions 1*a* and 1*b* into the bunker 3.

The transporter 1, including all the portions thereof and the crusher 2 are provided with a clothing so as to prevent any dust, which develops during transporting and comminuting the removed material, from being distributed in the main passage.

The particles 4 fall from the transporter 1 into the bunker 3 and from the bunker 3 into a rotary metering valve 5 (known e.g. from British Pat. No. 882,259) which is located immediately below the floor of the bunker 3. The rotary metering valve is rotated about a vertical axis. The reference numeral 6 is used to designate a feeding tube for introducing a hydraulic fluid (i.e. water) into the rotary valve 5, whereas the reference 6*a* is used to designate a withdrawing tube for withdrawing the hydraulic fluid from the rotary valve 5. The feeding tube 6 extends from above and through the bunker 3 and is open into the interior of the rotary valve 5 from an upper cover 5*a* thereof. The withdrawing tube 6*a* is open into the interior of the rotary valve 5 from below thereof, that is from the side which is opposite to the cover 5*a* of the rotary valve 5. The tubes 6 and 6*a* constitute a portion of a hydraulic system 7. During rotation of the rotary valve 5 the particles 4, which are in the valve 5, are rotated in the direction of the rotation of the valve 5. The valve 5 includes a number of cells, so that during the rotation of the valve 5 each cell, one after another, communicates with the withdrawing tube 6*a*. Thus the hydraulic fluid contained in a cell which is in communication with the withdrawing tube 6*a* flows from this cell into the withdrawing tube 6*a*. During flowing from the cell into the withdrawing tube 6*a*, the hydraulic fluid entrains the particles 4 contained in this cell and carries these particles 4 into the tube 6*a*.

The hydraulic system 7 is further provided with a pump unit 8 which is operative to correspondingly increase the pressure of the hydraulic fluid circulated through the rotary valve 5. The tubes 6 and 6*a* are connected directly to each other by a connecting conduit 9 which is operative to permit, if so desired, the hydraulic fluid to flow directly from the feeding tube 6 into the withdrawing tube 6*a*. This may occur when the mining process is stopped for one reason or another and it is necessary to keep the hydraulic system in operation; however, without introducing the hydraulic fluid into the rotary valve 5. The connecting conduit 9 is provided with a by-pass valve 11. The withdrawing tube 6*a* is provided with a check valve 10 which is actuated in response to the actuation of the by-pass valve 11. Thus, when the by-pass valve 11 is closed the check valve 10 is open and the hydraulic fluid flows through the rotary valve 5 into the withdrawing tube 6*a*. However, when the by-pass valve 11 is open the check valve 10 is closed and the hydraulic fluid flows directly from the feeding tube 6 into the withdrawing tube 6*a*, i.e. without being introduced into the rotary valve 5.

Both valves 10 and 11 may be throttle valves which can be operated together with a valve 12 which is located in the hydraulic system 7 before the pump unit 8 so as to vary the amount of the hydraulic fluid in the hydraulic system 7 in accordance with the actual situation.

Figure 2:
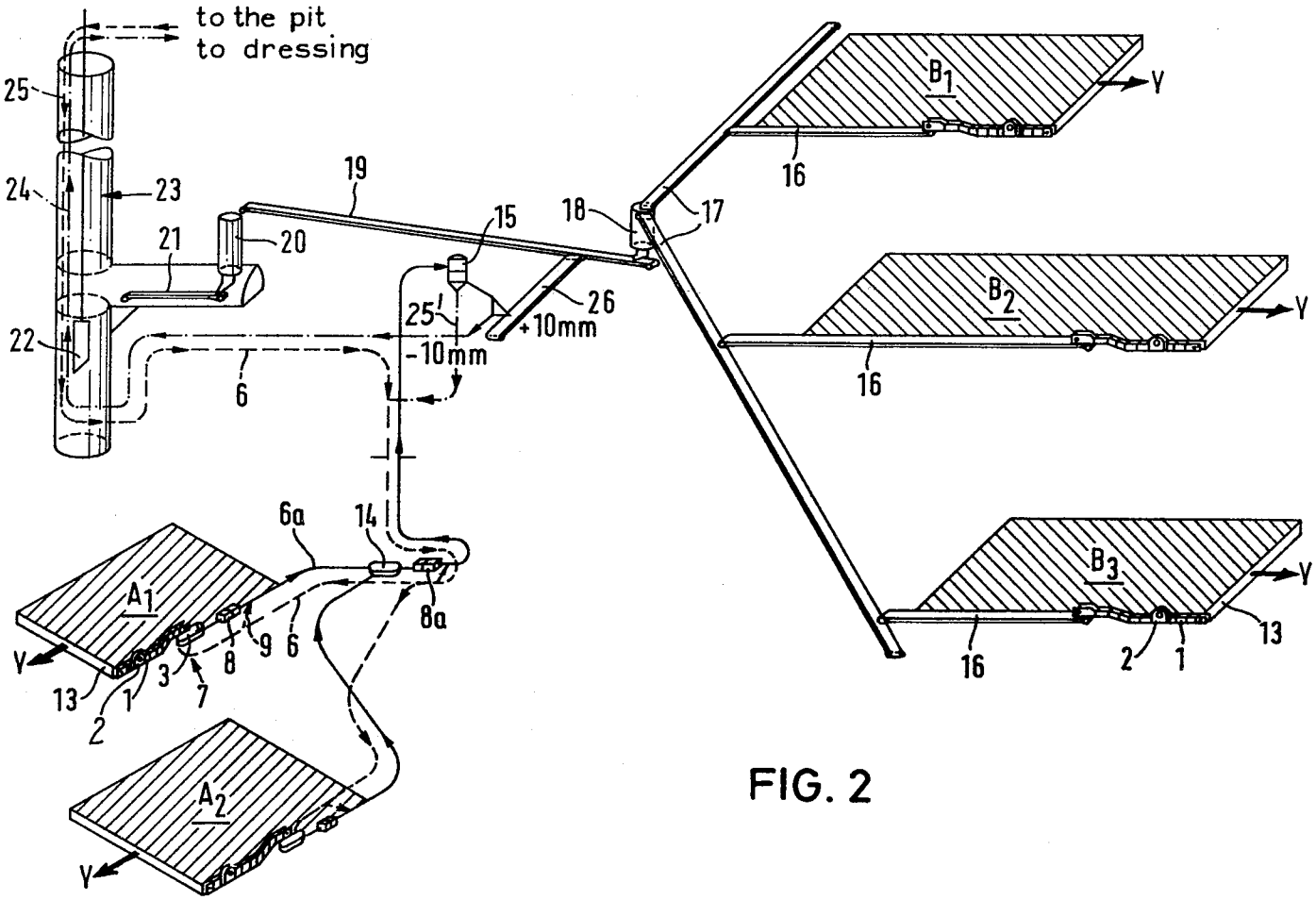
FIG. 2 is a scheme of one embodiment of a longwall mining system including the arrangement shown in FIG. 1.

FIG. 2 illustrates one embodiment of a longwall mining system where only a part of the extraction locations, i.e. $A_1$ and $A_2$ is provided with the hydraulic excavating systems 7 whereas the rest extraction locations, i.e. $B_1$, $B_2$ and $B_3$ are provided with conventional, for example, mechanical excavating arrangements.

The extraction of the material in each extraction location may be carried out by way of scraping and/or cutting the longwall mining faces of the respective extraction locations. An arrow V designates a direction of the progressive extraction. Thus, at all extraction locations the extraction is conducted in the direction away from the main passage.

The material removed in the working passage 13 is carried out by a movable transporter 1 through the crusher 2, which is rigidly mounted on the conveyor 1 for movement therewith, into the bunker 3. From the bunker 3, the comminuted particles 4 are transmitted through the withdrawing tube 6*a* of the hydraulic excavating system 7 in a collecting bunker 14 which is common for the extraction locations $A_1$ and $A_2$. From the collecting bunker 14 and through another pump unit 8*a* and particles 4 move into a vertical bunker 15.

The solid lines provided with arrows indicate the direction of flowing the hydraulic fluid from the respective extraction location, whereas the dotted lines provided with arrows indicate the direction of flowing the hydraulic fluid into the respective extraction location.

Each of the extraction locations $B_1$, $B_2$ and $B_3$ is provided with a double-chain conveyor which transports the removed material onto a band conveyor 16 which carries the removed material further onto another band conveyor 17 and into a common bunker 18. From the common bunker 18 the material removed at the extraction locations $B_1$, $B_2$ and $B_3$ is moved via band conveyors 19 and 21 and an intermediate bunker 20 into a hoisting arrangement 23 which is provided with a conventional skip winding 22 which carries the removed material onto the ground surface into a separating plant which is known per se and, therefore, does not require a detailed discussion or illustration.

In the vertical bunker 15, the hydraulically carried particles 4 (from the extraction locations $A_1$ and $A_2$) are separated from the hydraulic fluid and are subdivided into two (or more) fractions according to the size of the particles. Thus, a first fraction includes all particles 4 which have size less than 10 mm, whereas a second fraction includes all the rest of particles 4. The first fraction is excavated from the mine in form of sludge through a rising conduit 24, located within the hoisting arrangement 23, into the separating plant on the ground surface. The second fraction is transported by means of a band conveyor 26 onto the band conveyor 19. The reference numeral 25 designates a hydraulic fluid conduit in the hoisting arrangement 23. The conduit 25 communicates with the feeding tube 6. The hydraulic fluid separated in the bunker 15 is directed via a conduit 25' also into the tube 6.

Figure 3:
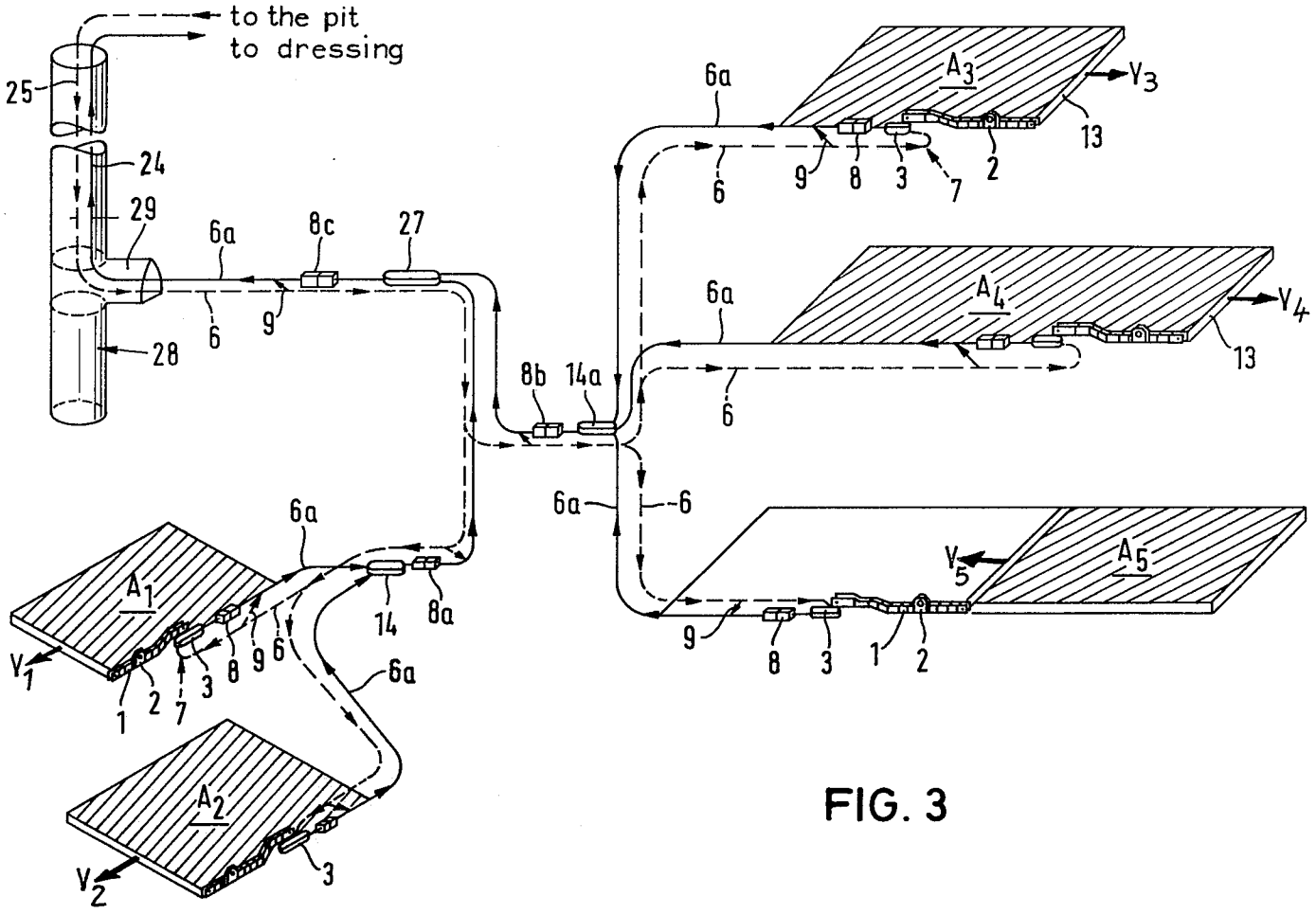
FIG. 3 is a scheme of another embodiment of the longwall mining system including the arrangement shown in FIG. 1.

FIG. 3 illustrates still another embodiment of the longwall mining system where all extraction locations, that is $A_1$, $A_2$, $A_3$, $A_4$ and $A_5$ are provided with the respective hydraulic excavating systems 7. The extraction of the material at the extraction locations $A_1$–$A_4$ is conducted in the direction away from the main passage (see arrows $V_1$–$V_4$), whereas the extraction of the material at the extraction location $A_3$ is conducted towards the main passage (see arrow $V_5$).

In the case of the embodiment shown in FIG. 3, the hydraulic fluid with the entrained particles 4 from the extraction locations $A_1$ and $A_2$ is collected in the collecting bunker 14, whereas the hydraulic fluid with the entrained particles 4 from the extraction locations $A_3$, $A_4$ and $A_5$ is collected in a collecting bunker 14*a*. The hydraulic fluids from the bunkers 14 and 14*a* are directed to a main collecting bunker 27, and further through a pump unit 8*c* and a tubular feeder (not shown) right into a rising conduit 24 of a hoisting arrangement 28, which has an extremely small diameter, onto the ground surface. The hydraulic fluid is separated from the particles on the ground surface and then is directed back through the return conduit 25 into the feeding tube 6 where the hydraulic fluid is distributed between the extraction locations $A_1$, $A_2$, $A_3$, $A_4$ and $A_5$.

The introducing of the hydraulic fluid into the rising conduit 24 and withdrawing of the hydraulic fluid from the same are conducted at a location 29 which is on a level located above the main level of the longwall mining system.

It will be understood that each of the elements described above, or two or more together, may find a useful application in other types of methods of and arrangements for longwall mining differing from the types described above.

While the invention has been illustrated and described as embodied in a method of and an arrangement for longwall mining, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In a method of longwall mining, the steps of removing material from a longwall mining face; transporting the removed material in the condition in which it was removed from the face and in dry state, in direction rearwardly away from the face; comminuting the transported material to obtain particles of a predetermined size; admitting the particles into a bunker at a pick-up location remote from the mine face; discharging the particles from the bunker into a hydraulic fluid so as to entrain and convey the particles from the pick-up location to a separating location; separating the particles at the separating location from the hydraulic fluid; and recirculating the separated hydraulic fluid back to the pick-up location for entrainment of additional particles thereat.

2. In a method as defined in claim 1, wherein said removed material is comminuted to obtain particles of a size between 80 mm and 150 mm.

3. In a method as defined in claim 1, wherein said particles have a size at least below 150 mm.

4. In a method as defined in claim 1, and further comprising the step of mixing said separated hydraulic fluid with an additional amount of the hydraulic fluid before the recirculating step.

5. In a method as defined in claim 4, wherein said recirculating and said entraining are conducted through a first conduit communicating with said pick-up location, said conveying step being conducted through a second conduit communicating with said pick-up location.

6. In a method as defined in claim 5, and further comprising the step of providing means for controlling the amount of the hydraulic fluid circulated through said pick-up location.

7. In a method as defined in claim 5, and further comprising the step of providing means for connecting said first conduit directly to said second conduit for selectively permitting the hydraulic fluid to flow from said first into said second conduit without flowing through said pick-up location.

8. In a method as defined in claim 1, wherein said transporting step constitutes the step of transporting the removed material from working passages into a main passage to a comminuting location situated in said main passage.

9. In a method as defined in claim 8, wherein said comminuting location has a breaker, said transporting step being carried out by a conveyor displacing said removed material from the longwall mining face in the direction towards and past said breaker, and further comprising the step of collecting the particles in the bunker which is located downstream of said breaker along said conveyor.

10. In a method as defined in claim 9, and further comprising the step of displacing said conveyor along the main passage.

11. In a method as defined in claim 1, wherein said material is removed from a plurality of extraction locations each having one said longwall mining face; and providing at least some of said extraction locations with said pick-up locations.

12. In a method as defined in claim 11, and further comprising the step of collecting the hydraulic fluids with the entrained particles withdrawn from said pick-up locations in a common bunker.

13. In a method as defined in claim 12, and further comprising the step of supplying under pressure said hydraulic fluid with the entrained particles collected in said common bunker in a direction outside of the mine towards the ground surface.

14. In a method as defined in claim 13, wherein said separating step is conducted on the ground surface.

15. In a method as defined in claim 13, and further comprising the step of providing a hoisting arrangement having a first conduit of a substantially small diameter for conducting the hydraulic fluid with the entrained particles to the ground surface and a second conduit of a substantially small diameter and separated from said first conduit for introducing the hydraulic fluid into the mine.

16. In a method as defined in claim 15, and further comprising the step of providing said hoisting arrangement with an inlet for the hydraulic fluid with the entrained particles and an outlet for the hydraulic fluid entering the mine, and locating said inlet and outlet in the mine separately from the main level thereof.

17. In a method as defined in claim 16, and further comprising the step of locating said inlet and outlet on a level above said main level.

18. In a method as defined in claim 12, wherein said separating step is conducted in said common bunker.

19. In a method as defined in claim 18; and further comprising the step of subdividing the particles into a fine-comminuted fraction and a coarse-comminuted fraction.

20. In a method as defined in claim 19, wherein said subdividing step is carried out after said separating step.

21. In a method as defined in claim 19, and further comprising the step of carrying said fine-comminuted fraction in form of sludge to the ground surface.

22. In a method as defined in claim 19, and further comprising the step of providing at least some of said plurality of extraction locations with mechanical means for carrying the removed material from said some of said plurality of extraction locations towards the ground surface.

23. In a method as defined in claim 22, and further comprising the step of mixing said coarse-comminuted fraction with the material removed from said some extraction locations.

24. An arrangement for longwall mining, comprising means for removing material to be excavated from a longwall mining face; means for transporting the removed material in the condition in which it was removed from the face and in dry state, in direction rearwardly away from the face; means for comminuting the transported material to obtain particles of predetermined size; means for admitting the particles into a bunker at a pick-up location remote from the mine face; means for discharging the particles from the bunker into a hydraulic fluid so as to entrain and convey the particles from said pick-up location through conduit means to a separating location; means for separating the entrained particles from the hydraulic fluid at said separating location; and means for recirculating the separated hydraulic fluid back to said pick-up location for entrainment of additional particles thereat.

25. An arrangement as defined in claim 24, and said circulating means including a feeding conduit communicating with said bunker, a withdrawing conduit communicating with said bunker and pumping means for introducing the hydraulic fluid under pressure into said bunker via said feeding conduit and withdrawing the hydraulic fluid with the entrained particles from said bunker via said withdrawing conduit.

26. An arrangement as defined in claim 25, said transporting means comprising scraper conveyor means for transporting the removed material towards and through said comminuting means and transporting the particles from said comminuting means into said bunker.

27. An arrangement as defined in claim 26, wherein said bunker means and said comminuting means are fixedly mounted on said conveyor means for movement together therewith along the main passage of a mine.

28. An arrangement as defined in claim 26, and further comprising means for preventing dust distribution in the main passage of a mine when the removed material is moved along said conveyor means through said comminuting means and towards said bunker.

29. An arrangement as defined in claim 28, wherein said preventing means include a plurality of covers dust-sealingly closing said conveyor means, said comminuting means and said bunker.

30. An arrangement as defined in claim 25, further comprising an intermediate element constituting said pick-up location and operative for receiving the particles from said bunker and said hydraulic fluid from said feeding conduit, said withdrawing conduit communicating with an interior of said intermediate element.

31. An arrangement as defined in claim 30, wherein said intermediate element is a rotary metering valve having a plurality of cells communicating one after another with said withdrawing conduit during rotation of said rotary metering valve about an axis.

32. An arrangement as defined in claim 25, and further comprising means for directly connecting said feeding conduit with said withdrawing conduit so that the hydraulic fluid can flow from said feeding conduit through said connecting means into said withdrawing conduit without being introduced into said bunker.

33. An arrangement as defined in claim 32, and further comprising means for closing the communication between said bunker and said withdrawing conduit when said directly connecting means are in operation.

34. An arrangement as defined in claim 32, wherein said connecting means include a connecting conduit communicating with said feeding conduit, said pumping means communicating with said feeding conduit upstream of the communication between the latter and said connecting conduit.

35. An arrangement as defined in claim 33, and further comprising means for closing said connecting means when the communication between said bunker and said withdrawing conduit is open, and opening said connecting means when said closing means close said communication between said bunker and said withdrawing conduit.

36. An arrangement as defined in claim 25, wherein said pumping means include a movable pump unit located adjacent said bunker and including a driving motor and a pressure pump.

37. An arrangement as defined in claim 24, wherein said comminuting means are adapted to comminute the removed material to obtain particles of a size between 80 mm and 150 mm.

38. An arrangement as defined in claim 24, wherein said comminuting means include a striking rolling crusher.

39. An arrangement as defined in claim 24, wherein the material is removed from a plurality of extraction locations each having said longwall mining face, at least some of said extraction locations are provided with hydraulic-fluid-circulating means, and further comprising means for receiving the hydraulic fluid with the entrained particles from all of said some extraction locations.

* * * * *